United States Patent [19]

Nishimura et al.

[11] Patent Number: 4,959,695

[45] Date of Patent: Sep. 25, 1990

[54] METHOD AND APPARATUS FOR FORMING A MULTICOLOR PICTURE BY ELECTROPHOTOGRAPHY

[75] Inventors: Katsuhiko Nishimura; Kazuyuki Shinho; Masahiro Kita, all of Tokyo, Japan

[73] Assignee: Asahi Kogaku Kogyo Kabushiki Kaisha, Tokyo, Japan

[21] Appl. No.: 36,512

[22] Filed: Apr. 9, 1987

[30] Foreign Application Priority Data

Apr. 9, 1986 [JP] Japan ..... 61-81895

[51] Int. Cl.[5] ..... G03G 15/01; G03G 15/02

[52] U.S. Cl. ..... 355/327; 355/219; 355/326; 430/42; 430/45

[58] Field of Search ..... 355/4, 3 R, 14 R, 14 D, 355/3 DD, 326, 327, 219; 430/42, 45

[56] References Cited

U.S. PATENT DOCUMENTS

| | | | |
|---|---|---|---|
| 4,033,688 | 7/1977 | Orthmann | 355/4 |
| 4,515,462 | 5/1985 | Yoneda | 355/326 X |
| 4,778,740 | 10/1988 | Takashima et al. | 355/208 X |

FOREIGN PATENT DOCUMENTS

| | | | |
|---|---|---|---|
| 0040851 | 4/1981 | Japan | 355/4 |
| 0147755 | 9/1983 | Japan | 355/4 |
| 0163961 | 9/1983 | Japan | 355/4 |
| 59-38762 | 3/1984 | Japan | 355/4 |
| 0221166 | 12/1984 | Japan | 355/4 |
| 0175243 | 3/1986 | United Kingdom | 430/42 |

*Primary Examiner*—A. T. Grimley
*Assistant Examiner*—Matthew S. Smith
*Attorney, Agent, or Firm*—Sughrue, Mion, Zinn, Macpeak & Seas

[57] ABSTRACT

In a method and apparatus of forming a muticolor picture by electrophotography, first color toner, second color toner and third color toner are allowed to stick onto a photosensitive material according to the conventional method. Then after the surface of the photosensitive material is discharged to decrease the surface potential thereof, a fourth color toner is allowed to stick onto the photosensitive material, whereby mixing of the fourth color with the first, second and third colors is prevented.

8 Claims, 2 Drawing Sheets

METHOD AND APPARATUS FOR FORMING A MULTICOLOR PICTURE BY ELECTROPHOTOGRAPHY

BACKGROUND OF THE INVENTION

1. Field of the Invention

This invention relates to a method and an apparatus for forming a multicolor picture by electrophotographic printing.

2. Background of the Invention

A method for forming a three-color picture in one by an electrophotographic process is known in the art. In this process, a first latent image is formed on a photosensitive material by application thereto of first color data and is then developed. A second latent image then is formed on the photosensitive material by application thereto of second color data and it is then developed. As a result, a first color toner, a second color and a third color toner toner are successively allowed to adhere to the photosensitive material. This method can provide a printer in which three different color toners are transferred onto a transferring sheet at the same time. That is, in principal, the method can provide a color printer. However, if, in addition to the three colors, black is used in the method, then the black coloring is mixed with the other three colors. However, a method of developing four color data on a photosensitive material in one process has not yet been proposed in the art. In such a case, an additional process has heretofore been employed to develop black on the transferring sheet onto which the three colors ahve been transferred.

SUMMARY OF THE INVENTION

Accordingly, an object of this invention is to provide a method an apparatus for forming a multicolor picture by electrophotography in which four different colors can be developed on a photosensitive material in one process without mixing with one another.

The foregoing object and other objects of the invention have been achieved by the provision of a method for forming a multicolor picture by electrophotography, in which, according to the invention, a first latent image is formed on a photosensitive material by application thereto of first color data and is developed, a second latent image is formed on the photosensitive material by application thereto of second color data and is developed, and a third latent image is formed on the photosensitive material by application thereto of third color data and is developed. As a result, a first color toner, a second color toner and a third color toner are successively allowed to adhere to the photosensitive material. After the surface of the photosensitive material is discharged to decrease the surface potential of the photosensitive material, a fourth latent image is formed on the photosensitive material by application thereto of fourth color data and is developed, so that a fourth color toner is allowed to adhere to the photosensitive material.

The surface potential of the photosensitive material can be decreased optically as well as electrically. That is, if the photosensitive material is exposed to a light beam which is sufficiently high in intensity as to pass through the three color toners which have been adhered to the photosensitive material, the surface potential of the photosensitive material is decreased. That is, the surface potential is restored to the initial value at which the surface of the photosensitive material had been before being charged for the formation of the first color latent image. Therefore, if, under this condition, the latent image for the fourth color is formed and developed, the fourth color toner adhered to the photosensitive material will never mix with the three color toners which have been previously applied to the photosensitive material.

The nature, principle and utility of the invention will become more apparent from the following detailed description when read in conjunction with the accompanying drawings.

Figure 4:
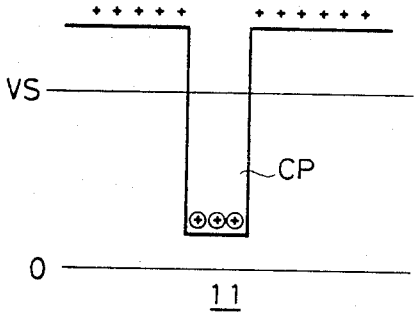
Figure 5:
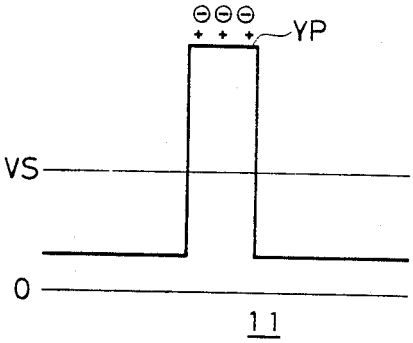

The parts (a) through (h) of FIG. 3 are explanatory diagrams showing the variation in potential of the surface of the photosensitive drum with the application of color data and the adhesion of four different color toners;

FIG. 4 is a diagram for a description of the principle of reversing development; and FIG. 5 is a diagram for a description of the principle of regular development.

DETAILED DESCRIPTION OF THE INVENTION

A method and an apparatus for forming a multicolor picture by electrophotography according to this invention will be described with reference to the accompanying drawings.

Figure 1:
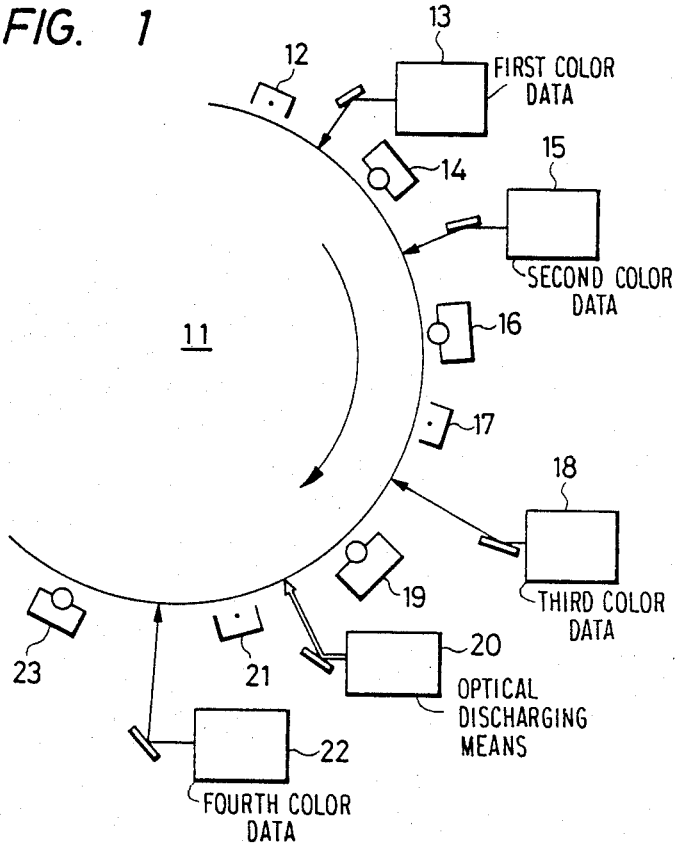
FIG. 1 is an explanatory diagram showing the arrangement of essential components in an apparatus for practicing a method for forming a multicolor picture by electrophotography according to this invention.

As shown in FIG. 1, a first charging unit 12, a means 13 for optically inputting first color data (hereinafter referred to as "a first color data inputting means 13") and a first color developing unit 14 of the non-contact or contact type are arranged around a photosensitive drum 11 in the stated order in the direction of rotation of the drum 11. Next, a means 15 for optically inputting second color data (hereinafter referred to as "a second color data inputting means 15") and a second color developing unit 16 of non-contact type are arranged on the drum 11. Thereafter, a second charging unit 17, a means for optically inputting third color data (hereinafter referred to as "a third color data inputting means 18"), and a third color developing unit 19 are arranged around the photosensitive drum 11. The above-described arrangement is substantially similar to that of the conventional three-color picture forming method, and three different color toners are allowed to adhere to the surface of the photosensitive drum 11.

The specific feature of the invention resides in that an optical discharging means 20 is disposed after the third color developing unit 19 and is followed by a third charging unit 21, a means for optically inputting fourth color data 22 (hereinafter referred to as "a fourth color data inputting means") and a fourth color developing unit 23 of the non-contact type in the stated order. The fourth color developing unit 23 is followed by well-known devices such as an image transferring unit for transferring an image on a transferring sheet, a discharging unit and a cleaning brush (not shown).

The optical discharging means 20 is adapted to expose the surface of the photosensitive drum 11 to a high intensity light beam through three color toners which have been adhered to the surface of the drum 11. More specifically, the optical discharging means 20 applies a high intensity light beam from a lamp such as a halogen lamp or flash lamp to the surface of the drum 11. As a result, the potential of the surface of the photosensitive drum 11 is decreased, so that formation of the latent image of the fourth color data and the development of the latent image can be readily achieved by the third charging unit 21, the fourth color data inputting means 22, and the fourth color developing means 23.

The method of the invention will be described with reference to FIGS. 2 and 3 in more detail.

Figure 2:
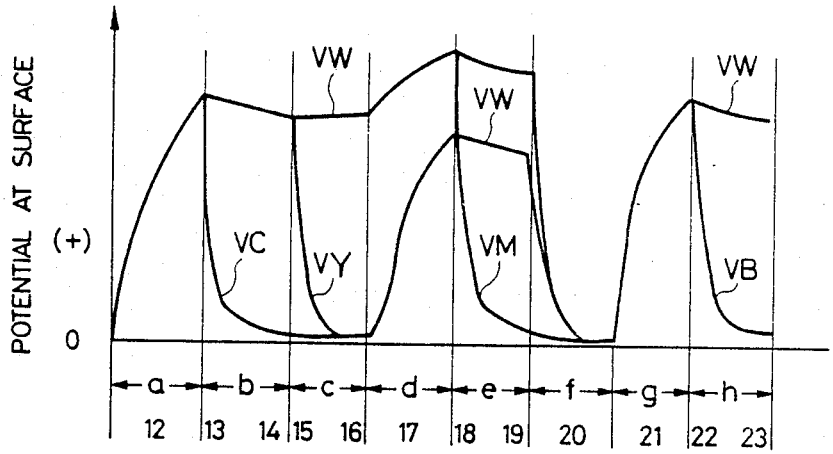
FIG. 2 is a graphical representation indicating the variation in potential of the surface of a photoelectric drum in the apparatus shown in FIG. 1.
Figure 3A:
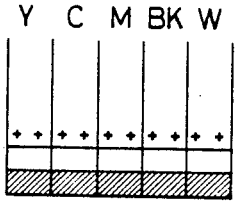
Figure 3B:
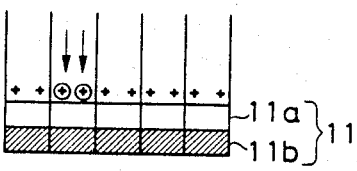
Figure 3C:
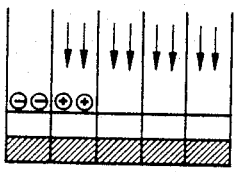
Figure 3D:
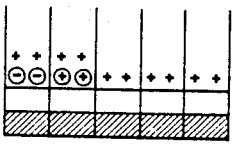
Figure 3E:
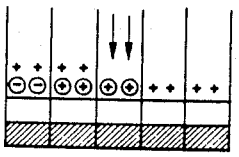
Figure 3F:
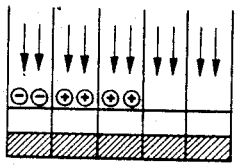
Figure 3G:
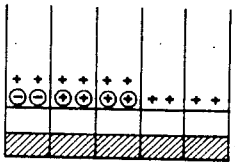
Figure 3H:
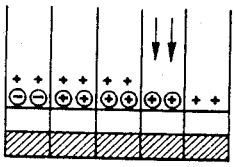

In the case of FIGS. 2 and 3, the first color is cyan (C), the second color is yellow (Y), the third color is magenta (M), and the fourth color is black (B).

FIG. 2 shows the variations of the surface potentials VC, VY, VM and VB which are provided respectively for the four colors C, Y, M and B when the color data of C, Y, M and B are respectively inputted and the latent images thereof are developed. In FIG. 2, reference character VW designates the potential of the region which is not developed, that is, the region appears white. The color white is designated by reference character W in FIG. 3. Referring back to FIG. 2, the numerals indicated below intervals a through h designate the devices in FIG. 1 which operate during the noted intervals, respectively. FIG. 3 shows the variation in charge of the surface of the photosensitive drum 11. In FIG. 3, each encircled symbol "+" or "−" indicates the adhering of predetermined toner there, and the arrows indicate the application of light for predetermined color data. As shown in FIG. 3, the photosensitive drum 11 has formed thereon a photosensitive layer 11*a* on top of a substrate 11*b*.

The surface potential of the photosensitive drum 11 is raised to a predetermined value by the first charging unit 12 (cf. the interval a in FIG. 2, and part (a) of FIG. 3). Under this condition, picture data including the cyan color data are applied to the photosensitive drum 11 by the first color data inputting means 13 so that its latent image is formed on the photosensitive drum 11. The latent cyan image is subjected to reverse development by the first color developing unit 14. As a result of the reverse development, the potential of the region where cyan is to be developed is decreased and the cyan toner (positively charged) is adhered to the region, whereas the remaining regions are maintained as they are. (cf. the interval b in FIG. 2, and part b of FIG. 3).

FIG. 4 shows the principle of reverse development. When cyan color data are inputted, the surface potential of the photosensitive drum 11 changes in a local area. More specifically, only the potential of the part CP of the drum surface for which the cyan color data are provided is decreased and its latent image is formed there. When a developing bias voltage $V_s$ lower than the surface potential is applied to the photosensitive drum 11 for the development of cyan, then the potential difference causes cyan toner (positively charged) to adhere only to the part CP.

Picture data including yellow color data are applied to the photosensitive drum 11 by regular development. More specifically, the second color data inputting means 15 is operated to form a latent image on the drum surface except for the part to which the yellow color data are to be applied. The latent yellow image thus formed is subjected to regular development by the second color developing unit 16. As a result, yellow toner (negatively charged) adheres to that part where the latent yellow image has been formed, and the remaining parts are maintained as they are (cf. the inteval c in FIG. 2, and part (c) of FIG. 3).

FIG. 5 shows the principle of regular development. The surface of the photosensitive drum 11 except for a part YP to which yellow color data are applied (hereinafter referred to as "a yellow color data part YP") is exposed to the light beam. Therefore, the yellow color data part YP is higher in potential than the remaining parts. When the developing bias voltage $V_s$ lower than the surface potential is applied to the photosensitive drum 11 for the development of yellow, then the potential difference causes yellow toner (negatively charged) to adhere only to the part YP.

The surface potential of the photosensitive drum 11, onto which two different colors (C and Y) of toner have been applied, is raised by the second charging unit 17 (cf. the interval d in FIG. 2, and part (d) of FIG. 3). Under this condition, picture data including magenta color data are applied to the photosensitive drum 11 by reverse development. That is, the third color data inputting means 18 is operated for the application of the magenta color data (to form the latent image), and the latent image thus formed is developed by the third color developing unit 19. (cf. the interval e in FIG. 2, and part (e) of FIG. 3). As a result, magenta toner (positively charged) is applied to the part to which the magenta color data have been applied. The reason why the surface potential of the photosensitive drum 11 is raised by the second charging unit 17 as was described above is that, in the interval c of FIG. 2 or in the case of part (c) of FIG. 3, the charge of the part which is not yet developed is substantially zero and that part is developed in the following step.

The above-described process is a conventional method of developing three colors. In succession to the above-described process, according to the invention, the optical discharging means 20 is operated to optically discharge the photosensitive drum 11 to decrease the surface potential, and then the fourth color data are applied to the photosensitive drum 11.

The cyan toner, the yellow toner and the magenta toner have been applied to the surface of the photosensitive drum 11 as was described above. Under this condition, the optical discharging unit 20 is operated to expose the surface of the photosensitive drum 11 to a high intensity light beam high as a result of which the surface potential of the photosensitive drum is uniformly lowered (cf. the interval f in FIG. 2, and part (f) of FIG. 3).

Under this condition, the surface potential of the photosensitive drum 11 is raised by the third charging unit 21 (cf. the interval g in FIG. 2, and part (g) of FIG. 3). Thereafter, the fourth color data inputting means 22 is operated to apply picture data including black color data to the photosensitive drum 11 to form the latent image thereon. The latent image is subjected to reverse development by the fourth color developing unit 23. As a result, black toner (positively charged) is applied to the part to which the black color data have been applied (cf. the interval h in FIG. 2, and part (h) of FIG. 3). The black color is developed on the surface of the photosensitive drum 11 which has been newly charged, and therefore it will never mix with the other colors, cyan, yellow and magenta.

The application of the picture data, including the color data by the first, second, third and fourth color data inputting means 13, 15, 18 and 22 is carried out through exposing-light scanning means such as a semiconductor laser.

In the above-described embodiment, the optical discharging means 20 is employed as discharging means. However, it may be replaced by electrical discharging means utilizing an AC corona.

As was described above, in the method of the invention, after the first, second and third colors have been developed on the photosensitive drum by the conventional method the surface of the photosensitive drum is discharged, and then the fourth color is developed. Accordingly, in the multi-color picture provided according to the method of the invention, the fourth color is not mixed with any of the first, second and third colors.

What is claimed is:

1. An electrographic method for forming a multicolor picture, comprising the steps of:

forming a first color image on a photosensitive material by applying first color data to said photosensitive material and developing said photosensitive material, thereby causing first color toner to adhere to said photosensitive material;

forming a second color image on said photosensitive material by applying second color data to said photosensitive material and developing said photosensitive material, thereby causing second color toner to adhere to said photosensitive material;

forming a third color image on said photosensitive material by applying third color data to said photosensitive material and developing said photosensitive material, thereby causing third color toner to adhere to said photosensitive material;

then discharging all of a surface of said photosensitive material to decrease a surface potential thereof;

recharging said discharging surface; and forming a fourth color image on said recharged surface of said photosensitive material by applying fourth color data to said recharged surface and developing said photosensitive material, thereby causing fourth color toner to adhere to said photosensitive material already having said first, second and third color toners adhered thereto, wherein at least one of said first, second and third color images is formed by a developing process using negatively charged toner and at least another one of said first, second and third color images is formed by a developing process using positively charged toner.

2. A method as recited in claim 1, wherein said discharging step comprises irradiating said surface with light.

3. A method as recited in claim 1, wherein prior to forming said first color image, there is a first step of charging said surface of said photosensitive material, and after forming said second color image but prior to forming said third color image, there is a second step of charging said surface of said photosensitive material.

4. A method as recited in claim 1, wherein said first, third and fourth color images are each formed by said developing process using positively charged toner, and said second color image is formed by said developing process using negatively charged toner, and said discharging is performed only after said third color image is formed.

5. An electrographic apparatus for forming a multicolor picture, comprising:

first means for applying first color data to a photosensitive material for developing said photosensitive material to form a first color image, whereby first color toner is adhered to said photosensitive material;

second means for applying second color data to said photosensitive material and for developing said photosensitive material to form a second color image, whereby second color toner is adhered to said photosensitive material;

third means for applying third color data to said photosensitive material and for developing said photosensitive material to form a third color image, whereby third color toner is adhered to said photosensitive material;

means for discharging a surface of said photosensitive material having said first, second and third color toners adhered thereto;

means for recharging said discharged surface of said photosensitive material; and fourth means for applying fourth color data to said recharged surface of said photosensitive material and for developing said photosensitive material to form a fourth color image, whereby fourth color toner is adhered to said photosensitive material, wherein at least one of said first, second and third color images is formed by a developing process using negatively charged toner and at least another one of said first, second and third color images is formed by a developing process using positively charged toner.

6. An electrographic apparatus as recited in claim 5, wherein said discharging means comprises optical discharging means.

7. An electrophotographic apparatus as recited in claim 5, wherein said apparatus further comprises first means for charging said photosensitive material prior to application of said first color data thereto, and second means for charging said photosensitive material after application of said second color data thereto but prior to application of said third color data thereto.

8. An electrographic apparatus as recited in claim 5, wherein said first means, said third means and said fourth means develop said first, third and fourth color data, respectively, by said developing process using positively charged toner, and said second means develops said second color image by said developing process using negatively charged toner, and said means for discharging discharges said surface of said photosensitive material only after said third color image is formed.

* * * * *